US009497547B2

(12) United States Patent
Chen et al.

(10) Patent No.: US 9,497,547 B2
(45) Date of Patent: Nov. 15, 2016

(54) SPEAKER STRUCTURE

(71) Applicant: ASIA VITAL COMPONENTS CO., LTD., New Taipei (TW)

(72) Inventors: Mao-Lin Chen, New Taipei (TW); Chih-Chiang Chao, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 369 days.

(21) Appl. No.: 13/974,002

(22) Filed: Aug. 22, 2013

(65) Prior Publication Data

US 2015/0055818 A1 Feb. 26, 2015

(51) Int. Cl.

| | |
|---|---|
| ***H04R 9/04*** | (2006.01) |
| *H04R 1/06* | (2006.01) |
| *H04R 7/04* | (2006.01) |

(52) U.S. Cl.

CPC ..... *H04R 9/041* (2013.01); *H04R 1/06* (2013.01); *H04R 7/04* (2013.01)

(58) Field of Classification Search

USPC ..... 381/400, 409, 433

See application file for complete search history.

(56) References Cited

U.S. PATENT DOCUMENTS

| | | | | |
|---|---|---|---|---|
| 2004/0218779 | A1* | 11/2004 | Fukuyama et al. | 381/409 |
| 2009/0046889 | A1* | 2/2009 | Huang | 381/433 |
| 2013/0136280 | A1* | 5/2013 | Stephanou | H04R 17/00 381/190 |

FOREIGN PATENT DOCUMENTS

| | | | |
|---|---|---|---|
| CN | 2774063 | Y | 4/2006 |
| CN | 102036147 | A | 4/2011 |

* cited by examiner

*Primary Examiner* — Duc Nguyen
*Assistant Examiner* — Phan Le
(74) *Attorney, Agent, or Firm* — C. G. Mersereau; Nikolai & Mersereau, P.A.

(57) ABSTRACT

A speaker structure includes a main body, a circuit board and a magnetic component. The main body has a receiving section and a recess formed on an outer circumference of the receiving section. A center of the main body is formed with a hole in communication with the receiving section. The circuit board has a board body and an outer frame body inlaid in the recess of the main body. The magnetic component is received in the hole. A voice coil collar is disposed around the magnetic component. Multiple windings are wound around a surface of the voice coil collar. Two ends of the windings are attached to the circuit board. According to the above arrangement, the volume of the speaker structure is greatly reduced and the manufacturing cost of the speaker structure is lowered.

8 Claims, 9 Drawing Sheets

SPEAKER STRUCTURE

BACKGROUND OF THE INVENTION

1. Field of the Invention

The present invention relates generally to a speaker structure, which has a greatly minified volume and is manufactured at lower cost.

2. Description of the Related Art

In recent years, along with the miniaturization of various digital electronic products and video/audio products such as audiphones and earphones, the speakers installed on these products have been more and more required to be thinned, miniaturized and lightweight. Also, the dynamic range of the output signal of these products is enlarged so that the speakers are required to have higher output volume.

The speaker is a kind of converter for converting electrical energy into sonic energy through physical effect. According to different physical effects of conversion between electrical energy and sonic energy, the speakers can be classified into many types such as electromagnetic speakers, piezoelectric speakers, capacitive speakers or electrical speakers. In these speakers, the electrical speaker has a relatively simple structure and good performance so that the electrical speaker is popularly used as a mainstream of the currently developed and produced speakers.

According to the different effects of the respective parts of the speaker, the basic structure of the speaker can be classified into three parts of vibration system, magnetic circuit system and auxiliary system. Please refer to FIG. 1, which is a sectional view of a conventional speaker structure 1. The conventional speaker structure 1 includes a magnetic circuit system composed of a basin support 10, an upper board (washer) 11, a lower board (T-iron) 12 and a magnet 13. The speaker structure 1 further has a vibration membrane 14. In addition, a transitional dangling edge 15 is connected between the vibration membrane 14 and the basin support 10 for achieving better smoothness of the vibration system of the speaker. The dangling edge 15 is generally integrated with the vibration membrane 14. The speaker structure 1 further has a damper 16 mainly for supporting and locating the vibration system of the speaker 1. In addition, the speaker structure 1 includes a voice coil 17 as a drive source of the vibration system of the speaker 1. The voice coil 17 is generally composed of a voice coil collar and windings.

The working principle of the speaker is that the current intensity and the direction of the force applied to the voice coil are changed so that the voice coil is back and forth vibrated in the magnetic gap. The period or frequency of the vibration is equal to the period or frequency of the input current. The amplitude of the vibration is in direct proportion to the instantaneous intensity of the acting current. The woofer vibration membrane and the tweeter vibration membrane are fixed on the voice coil so that the voice coil can drive the woofer vibration membrane and the tweeter vibration membrane to up and down vibrate and radiate sonic wave. Accordingly, the electrical energy is converted into sonic energy.

However, under the affection of the conventional speaker structure, there must be a certain buffering distance between the voice coil and the magnet. Also, there must be a certain buffering distance between the vibration membrane and the damper and there must be a certain buffering distance between the dangling edge and the basin support. Therefore, the total thickness of the speaker is considerably large. As a result, the conventional speaker can be hardly thinned. Due to the limitation of the thickness, the conventional speaker can be hardly applied to the current thin electronic products.

Furthermore, the conventional speaker is composed of numerous components and is manufactured by a complicated process. Therefore, it is quite time-consuming to produce the conventional speaker and the manufacturing cost of the conventional speaker is quite high.

According to the above, the conventional speaker structure has the following shortcomings:

1. The volume and thickness of the conventional speaker are considerably large so that the conventional speaker cannot be applied to the current thin electronic products.
2. The manufacturing cost of the conventional speaker is quite high and the working time of the conventional speaker is relatively long.

SUMMARY OF THE INVENTION

It is therefore a primary object of the present invention to provide a speaker structure, which has a greatly minified volume.

It is a further object of the present invention to provide the above speaker structure, which is manufactured at lower cost and shortened working time.

To achieve the above and other objects, the speaker structure of the present invention includes a main body, a circuit board and a magnetic component. The main body has a receiving section and a recess formed on an outer circumference of the receiving section. A center of the main body is formed with a hole in communication with the receiving section. The circuit board has a board body and an outer frame body outward extending from a periphery of the board body. The outer frame body is inlaid in the recess of the main body. The circuit board has a first face and a second face opposite to the first face. The magnetic component is received in the hole. A voice coil collar is disposed around the magnetic component. One end of the voice coil collar is connected to the second face of the circuit board. Multiple windings are wound around a surface of the voice coil collar. Two ends of the windings are attached to the circuit board.

According to the above arrangement, the circuit board is employed instead of the vibration membrane and damper of the conventional speaker. When the current passes through the windings wound around the voice coil collar, an electromagnetic field is created, whereby the voice coil collar and the circuit board will be vibrated together to drive the ambient air to vibrate. The instantaneous contraction/expansion tempo will make the airflow vibrate to create sonic wave and emit a sound to human ears. In this case, the electrical energy is converted into sonic energy and the sound is recovered to a user to listen to.

Moreover, in the speaker structure of the present invention, the circuits of the speaker structure are integrated on the circuit board. Also, the soldering points and lead wires for fixing the windings are integrated on the circuit board to simplify the manufacturing process and lower the cost.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
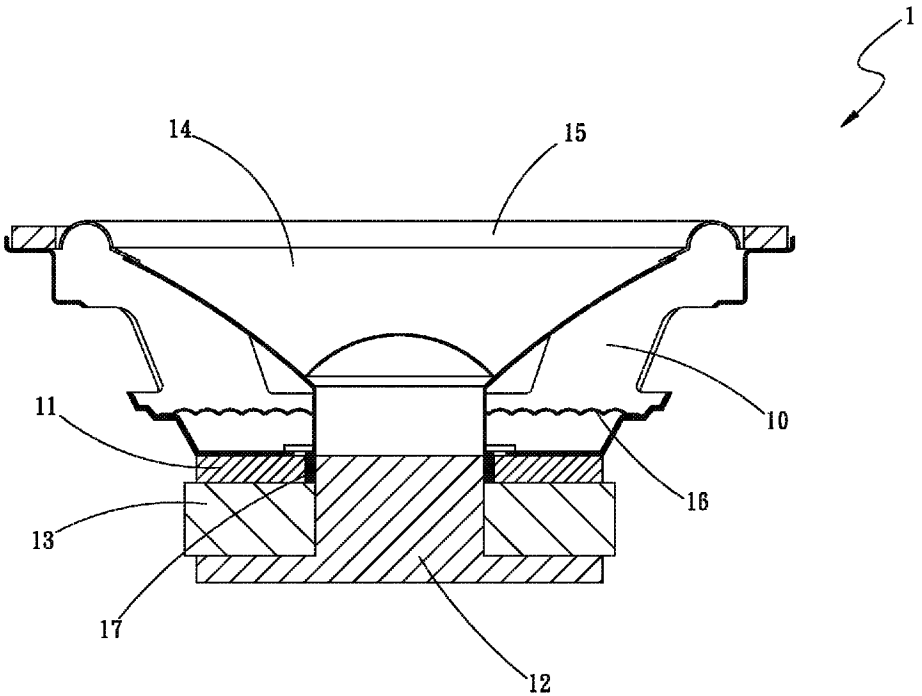
(PRIOR ART) Fig. 1
FIG. 1 is a sectional view of a conventional speaker structure.
Figure 2A:
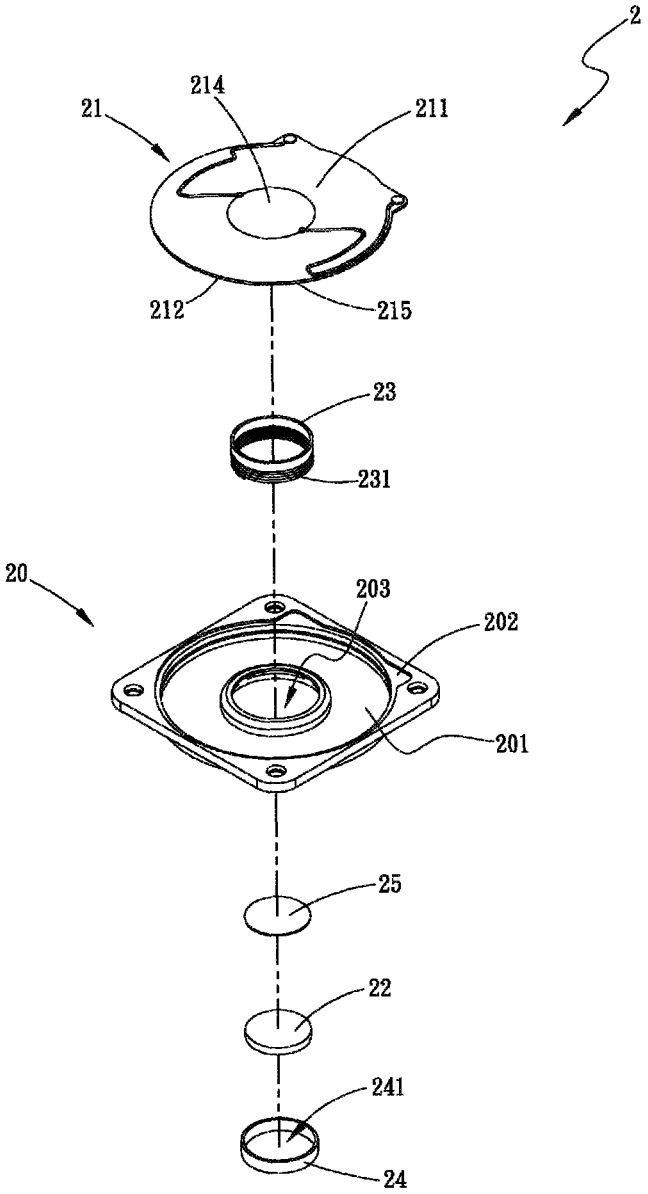
FIG. 2A is a perspective exploded view of a first embodiment of the speaker structure of the present invention.
Figure 2B:
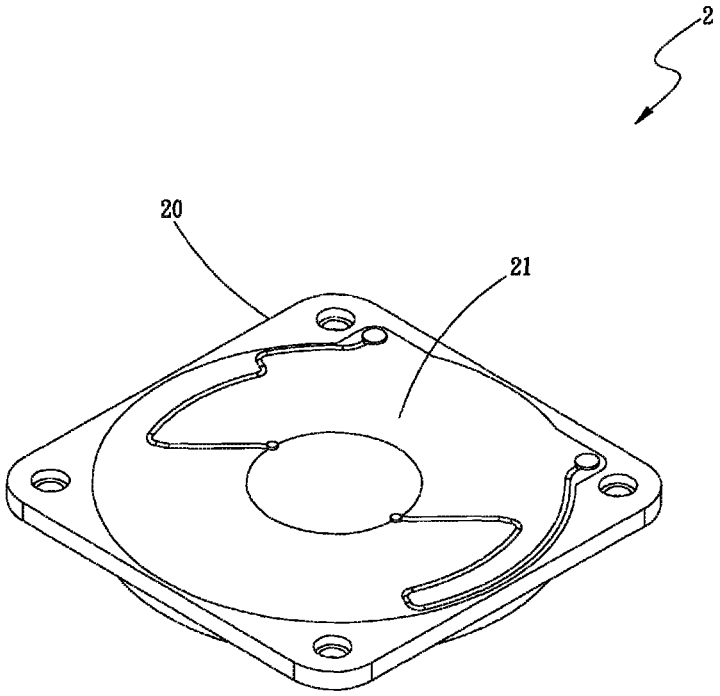
FIG. 2B is a perspective assembled view of the first embodiment of the speaker structure of the present invention.
Figure 2C:
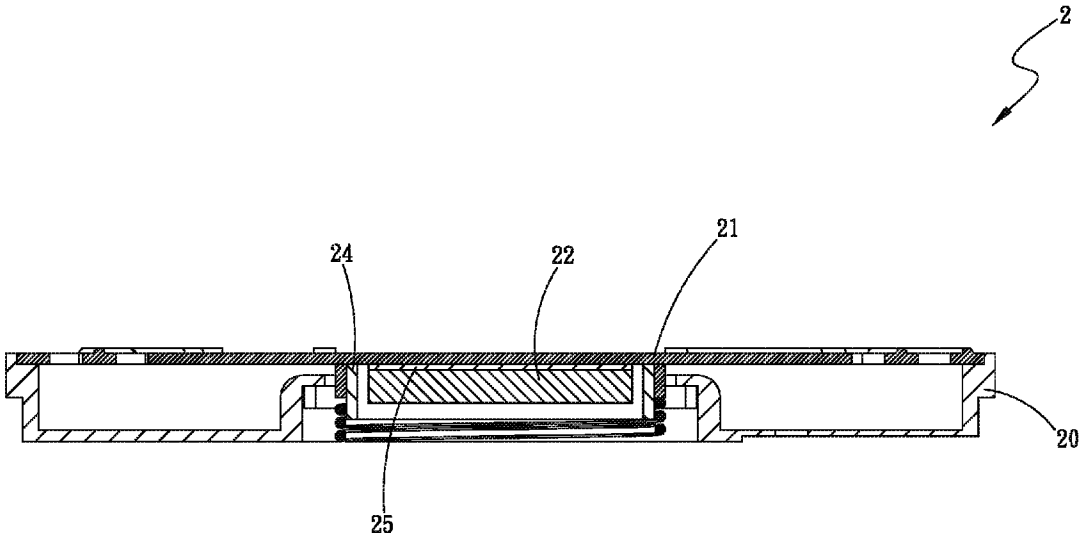
FIG. 2C is a sectional view of the first embodiment of the speaker structure of the present invention.

Please refer to FIGS. 2A, 2B and 2C. FIG. 2A is a perspective exploded view of a first embodiment of the speaker structure of the present invention. FIG. 2B is a perspective assembled view of the first embodiment of the speaker structure of the present invention. FIG. 2C is a sectional view of the first embodiment of the speaker structure of the present invention. According to the first embodiment, the speaker structure 2 of the present invention includes a main body 20, a circuit board 21 and a magnetic component 22. The main body 20 has a receiving section 201 and a recess 202 formed on an outer circumference of the receiving section 201. A center of the main body 20 is formed with a hole 203 in communication with the receiving section 201.

The circuit board 21 has a board body 211 and an outer frame body 212 outward extending from a periphery of the board body 211. The outer frame body 212 is inlaid in the recess 202 of the main body. The circuit board 21 has a first face 214 and a second face 215 opposite to the first face 214.

A voice coil collar 23 is disposed around the magnetic component 22. One end of the voice coil collar 23 is connected to the second face 215 of the circuit board 21. Multiple windings 231 are wound around the surface of the voice coil collar 23. Two ends of the windings 231 are attached to the circuit board 21. After current is applied to the windings 231, the current is conducted to the voice coil collar 23, whereby the voice coil collar 23 is vibrated to drive the circuit board 21 to vibrate along with the voice coil collar 23.

In addition, a magnetically conductive component 24 is disposed around the magnetic component 22. The magnetically conductive component 24 is formed with a receiving hole 241 for receiving the magnetic component 22. A pad member 25 is disposed between one face of the magnetic component 22 and the second face 215 of the circuit board 21. The pad member 25 and the magnetic component 22 are received in the hole 203 of the main body 20.

In this embodiment, the circuit board 21 is, but not limited to, a flexible printed circuit (FPC) for illustration purposes. In practice, the circuit board 21 can be any circuit board, which can be vibrated when current passes through the windings 231 to create an electromagnetic field and make the magnetic component 22 and the voice coil collar 23 act on each other. For example, alternatively, the circuit board 21 can be a printed circuit board (PCB).

According to the above arrangement, the circuit board 21 is employed instead of the vibration membrane and damper of the conventional speaker. Referring to FIG. 2C, after assembled, the thickness and volume of the speaker structure 2 are greatly reduced. This is quite suitable for the modern electronic product stressing lightweight, thinness and miniaturization. The working principle of the speaker structure 2 is that when the current passes through the windings 231, an electromagnetic field is created to make the voice coil collar 23 and the magnetic component 22 received therein act on each other. The voice coil collar 23 is connected to the second face 215 of the circuit board 21. Accordingly, when the current passes through the windings 231 wound around the voice coil collar 23, the voice coil collar 23 and the circuit board 21 will be vibrated together to drive the ambient air to vibrate. The instantaneous contraction/expansion tempo will make the airflow vibrate to create sonic wave and emit a sound to human ears. In this case, the electrical energy is converted into sonic energy and the sound is recovered to a user to listen to.

Moreover, in the speaker structure 2 of the present invention, the circuits of the speaker structure 2 can be integrated on the circuit board 21. Also, the soldering points and lead wires for fixing the windings 231 can be integrated on the circuit board 21 to simplify the manufacturing process and lower the cost.

Figure 3A:
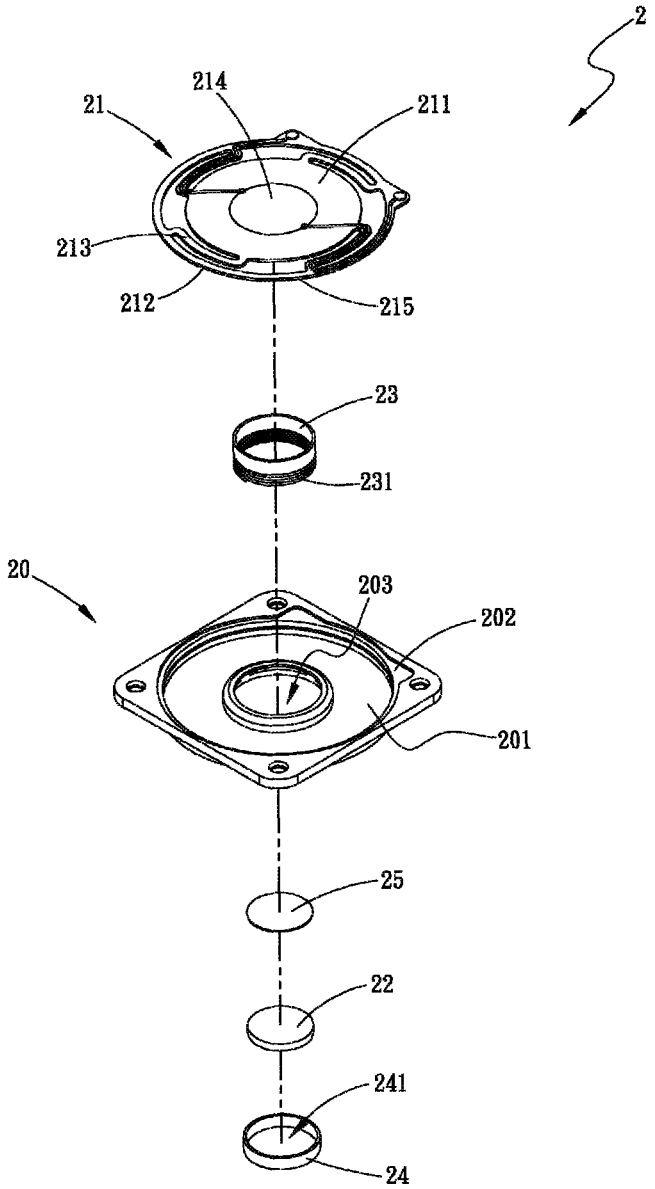
FIG. 3A is a perspective exploded view of a second embodiment of the speaker structure of the present invention.
Figure 3B:
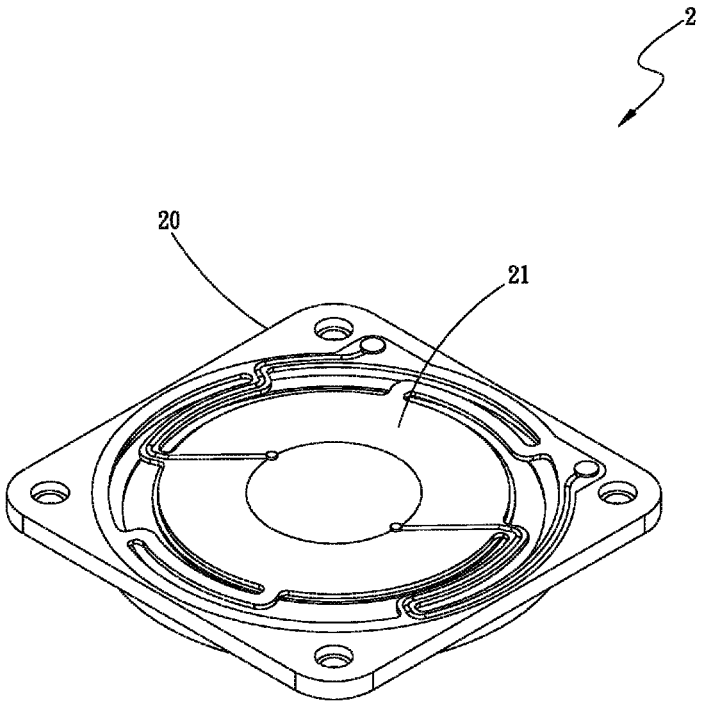
FIG. 3B is a perspective assembled view of the second embodiment of the speaker structure of the present invention.

Please now refer to FIGS. 3A and 3B. FIG. 3A is a perspective exploded view of a second embodiment of the speaker structure of the present invention. FIG. 3B is a perspective assembled view of the second embodiment of the speaker structure of the present invention. The second embodiment is partially identical to the first embodiment in component and relationship between the components and thus will not be repeatedly described hereinafter. The second embodiment is different from the first embodiment in that the circuit board 21 further has multiple support sections 213. One end of the support sections 213 is connected to the board body 211, while the other end of the support sections 213 is connected to the outer frame body 212. The outer frame body 212 is inlaid in the recess 202 of the main body 20. The windings 231 are partially attached to the outer frame body 212 and the support sections 213. Two ends of the windings 231 are eventually attached to the board body 211. Accordingly, the circuits are integrated on the circuit board 21.

Figure 4:
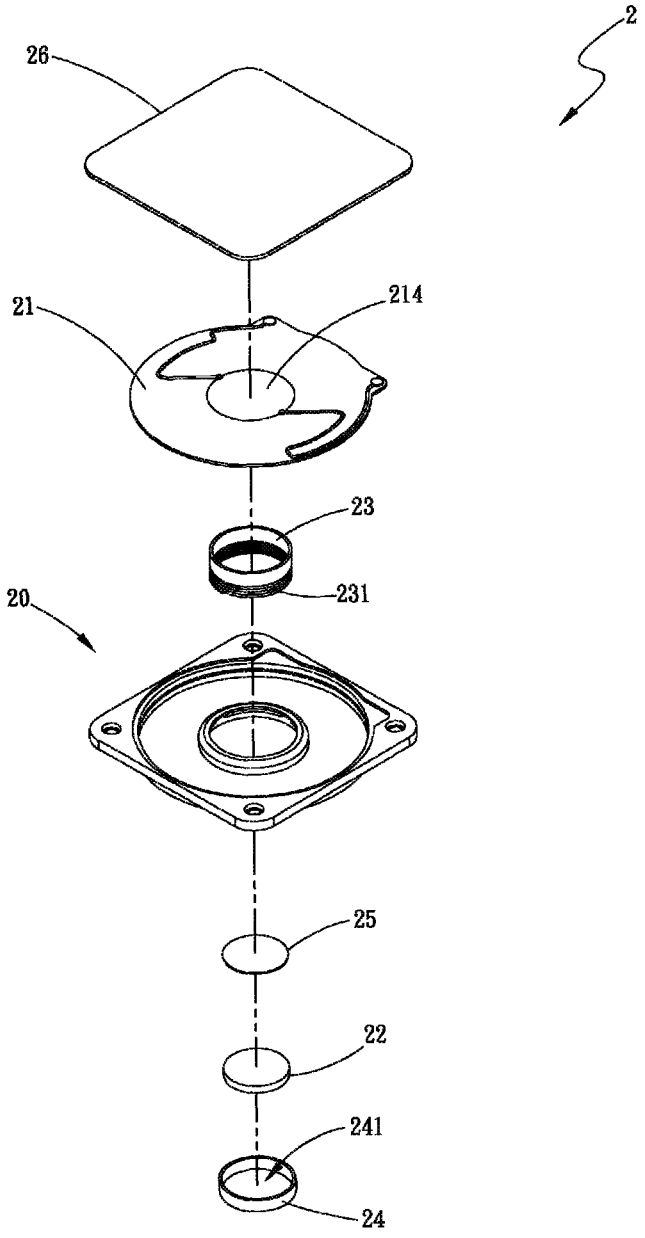
FIG. 4 is a perspective exploded view of a third embodiment of the speaker structure of the present invention.

Please now refer to FIG. 4, which is a perspective exploded view of a third embodiment of the speaker structure of the present invention. The third embodiment is partially identical to the first embodiment in component and relationship between the components and thus will not be repeatedly described hereinafter. The third embodiment is different from the first embodiment in that a glass member 26 is further disposed on the first face 214 of the circuit board 21. In this embodiment, the glass member 26 is a thin glass piece. The glass member 26 is connected to the periphery of the circuit board 21. When the current passes through the windings 231, an electromagnetic field is created to make the voice coil collar 23 and the magnetic component 22 received therein act on each other. The voice coil collar 23 is connected to the second face 215 of the circuit board 21. Accordingly, when the current passes through the windings 231 wound around the voice coil collar 23, the voice coil collar 23 and the circuit board 21 will be vibrated together. The vibration will be conducted to the glass member 26. The glass member 26 has a rigidity larger than that of the circuit board 21 so that the vibration frequency of the speaker structure 2 is increased to enhance the quality of the output sound and increase the intensity of the sound. Moreover, in comparison with the glass member 26, the vibration frequency of the circuit board 21 is lower. Therefore, the combination of the glass member 26 and the circuit board 21 of the speaker structure 2 can provide both high-frequency and low-frequency sounds to achieve a complementary effect.

Figure 5:
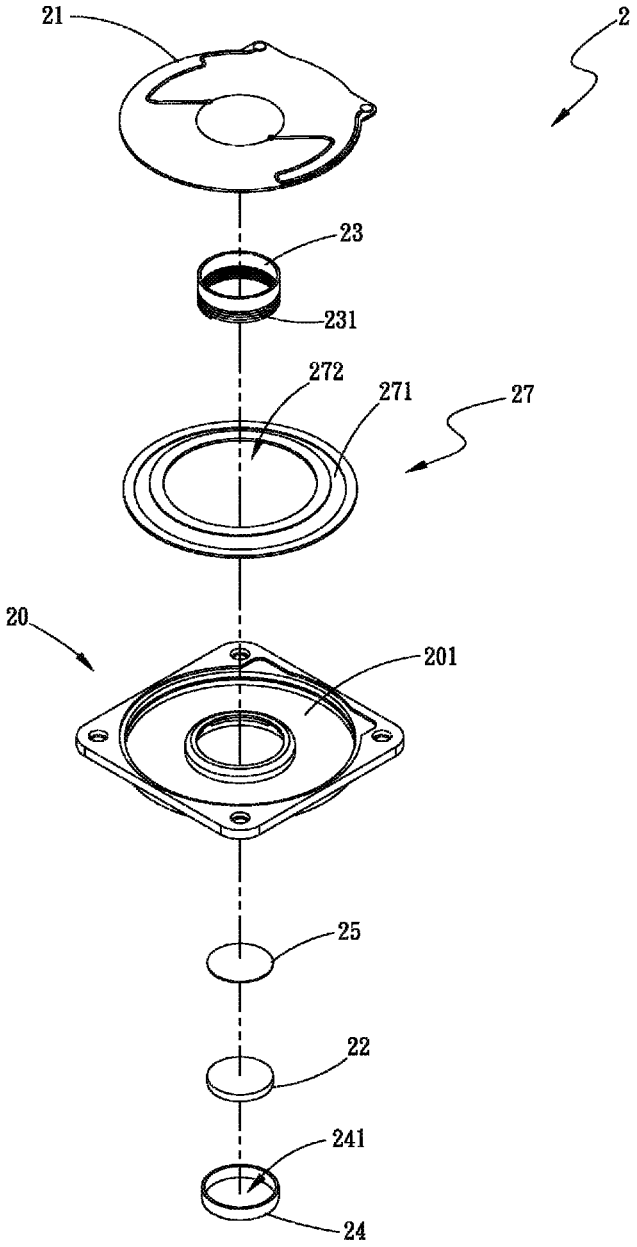
FIG. 5 is a perspective exploded view of a fourth embodiment of the speaker structure of the present invention.

Please now refer to FIG. 5, which is a perspective exploded view of a fourth embodiment of the speaker structure of the present invention. The fourth embodiment is partially identical to the first embodiment in component and relationship between the components and thus will not be repeatedly described hereinafter. The fourth embodiment is different from the first embodiment in that a dangling edge 27 is further attached to the receiving section 201. The dangling edge 27 is formed with multiple annular sections 271 and a central through hole 272 in communication with the hole 203. The dangling edge 27 can be made of foam rubber, fabric, rubber or nylon.

Figure 6:
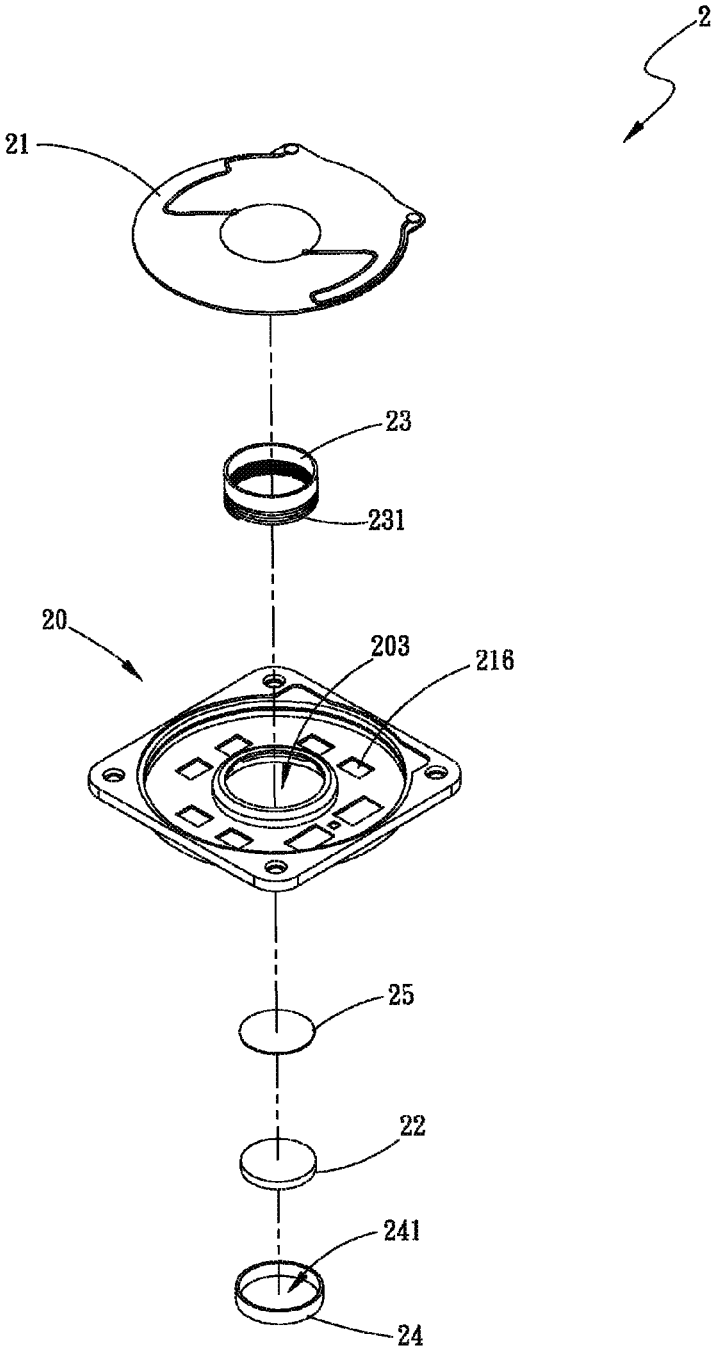
FIG. 6 is a perspective exploded view of a fifth embodiment of the speaker structure of the present invention.

Finally, please now refer to FIG. 6, which is a perspective exploded view of a fifth embodiment of the speaker structure of the present invention. The fifth embodiment is partially identical to the first embodiment in component and relationship between the components and thus will not be repeatedly described hereinafter. The fifth embodiment is different from the first embodiment in that the main body 20 is further formed with multiple perforations 216 around the hole 203 in communication with the receiving section 201.

In comparison with the conventional structure, the present invention has the following advantages:

1. The volume and thickness of the speaker structure are greatly reduced so that the speaker structure is applicable to the current thin electronic products.
2. The manufacturing cost is greatly lowered and the working time is shortened.

The present invention has been described with the above embodiments thereof and it is understood that many changes and modifications in the above embodiments can be carried out without departing from the scope and the spirit of the invention that is intended to be limited only by the appended claims.

What is claimed is:

1. A speaker structure comprising:

a main body having a receiving section and a recess formed on an outer circumference of the receiving section, a center of the main body being formed with a hole in communication with the receiving section;

a circuit board having a board body and an outer frame body outward extending from a periphery of the board body, the outer frame body being inlaid in the recess of the main body, the circuit board having a first face and a second face opposite to the first face; and a magnetic component received in the hole, a voice coil collar being disposed around the magnetic component, one end of the voice coil collar being connected to the second face of the circuit board, multiple windings being wound around a surface of the voice coil collar, two ends of the windings being attached to the circuit board;

wherein a glass member is further disposed on the first face of the circuit board, the glass member being connected to the circuit board, the glass member having a rigidity larger than that of the circuit board, whereby the glass member and the circuit board of the speaker structure can high-frequency co-vibrate.

2. The speaker structure as claimed in claim 1, wherein a magnetically conductive component is disposed around the magnetic component, the magnetically conductive component being formed with a receiving hole for receiving the magnetic component.

3. The speaker structure as claimed in claim 1, wherein a pad member is disposed between one face of the magnetic component and the second face of the circuit board, the pad member received in the hole.

4. The speaker structure as claimed in claim 1, wherein a dangling edge is further attached to the receiving section, the dangling edge being formed with multiple annular sections and a central hole in communication with the hole.

5. The speaker structure as claimed in claim 4, wherein the dangling edge is made of foam rubber, fabric, rubber or nylon.

6. The speaker structure as claimed in claim 1, wherein the circuit board is a printed circuit board (PCB) or a flexible printed circuit (FPC).

7. The speaker structure as claimed in claim 6, wherein the circuit board further has multiple support sections, two ends of the support sections being respectively connected to the board body and the outer frame body.

8. The speaker structure as claimed in claim 1, wherein the main body is further formed with multiple perforations around the hole in communication with the receiving section.

* * * * *